US006091287A

United States Patent [19]

Salter et al.

[11] Patent Number: 6,091,287

[45] Date of Patent: Jul. 18, 2000

[54] VOLTAGE REGULATOR WITH AUTOMATIC ACCELERATED AGING CIRCUIT

[75] Inventors: Eric Johan Salter; Joseph John Nahas; William Luther Martino, Jr., all of Austin, Tex.

[73] Assignee: Motorola, Inc., Schaumburg, Ill.

[21] Appl. No.: 09/012,414

[22] Filed: Jan. 23, 1998

[51] Int. Cl.[7] ..... G05F 1/10

[52] U.S. Cl. ..... 327/543; 327/539; 327/408

[58] Field of Search ..... 327/407, 408, 327/411, 538, 539, 540, 541, 543; 323/311, 312, 313

[56] References Cited

U.S. PATENT DOCUMENTS

| | | | |
|---|---|---|---|
| 5,371,419 | 12/1994 | Sundby | 327/543 |
| 5,426,386 | 6/1995 | Mattews et al. | 327/63 |
| 5,614,816 | 3/1997 | Nahas | 323/316 |
| 5,712,590 | 1/1998 | Dries et al. | 327/539 |
| 5,856,756 | 1/1999 | Sasahara et al. | 327/540 |
| 5,909,142 | 6/1999 | Kawasaki et al. | 327/543 |

*Primary Examiner*—Tuan T. Lam
*Attorney, Agent, or Firm*—Daniel D. Hill

[57] ABSTRACT

A voltage regulator with automatic accelerated aging circuit (200) includes a comparator (202), a switched voltage divider (204), and a current-to-voltage converter (224). The voltage regulator (200) is implemented in an integrated circuit and monitors a power supply voltage provided to the integrated circuit. When the power supply voltage is within a first normal voltage range, the voltage regulator (200) provides a normal internal supply voltage to the integrated circuit. When the power supply voltage is within a second higher voltage range, the voltage regulator (200) automatically provides a higher than normal internal power supply voltage to the circuits of an integrated circuit for causing accelerated aging of the integrated circuit during burn-in reliability testing.

16 Claims, 4 Drawing Sheets

VOLTAGE REGULATOR WITH AUTOMATIC ACCELERATED AGING CIRCUIT

FIELD OF THE INVENTION

This invention relates generally to integrated circuits, and more particularly, to a voltage regulator having an automatic accelerated aging circuit for an integrated circuit.

BACKGROUND OF THE INVENTION

As part of the manufacturing process of integrated circuits, the integrated circuits typically undergo reliability testing. One such reliability test is commonly known as burn-in. Burn-in testing involves the testing of an integrated circuit for an extended period of time while the temperature of the integrated circuit is elevated above room temperature. Operating the integrated circuit while at an elevated temperature for an extended period stresses the integrated circuit and may cause a failure that would not occur at room temperature. However, semiconductor manufacturers have the cost savings goal of testing, and screening out, defective integrated circuits as quickly and as early as possible in the manufacturing process.

One way of reducing the time required to conduct burn-in testing is to operate the integrated circuit during burn-in using a higher power supply voltage than normal. This will cause accelerated aging of the integrated circuit, thus causing the integrated circuit to fail, if it is going to, more quickly than testing at elevated temperatures but with a normal power supply voltage.

Integrated circuits are fabricated using a manufacturing process technology that is designed to operate optimally at a particular power supply voltage. However, some systems, such as for example, a personal computer, may require a power supply voltage that is different than the power supply voltage for which the integrated circuit was designed to operate. Because it is desirable to be able to operate certain integrated circuits in a variety of systems requiring different supply voltages, the integrated circuit may include an onboard voltage regulator that provides the correct internal power supply voltage to the circuits of the integrated circuit substantially independent of the system's power supply voltage.

One problem with using a voltage regulator is that burn-in cannot be conducted on the integrated circuit using higher than normal power supply voltages. Thus, the time required to perform burn-in is extended.

Therefore, a need exists for a voltage regulator that allows a higher than normal power supply to be provided to the circuits of an integrated circuit during burn-in, while providing a normal power supply voltage during normal operation.

BRIEF DESCRIPTION OF THE DRAWINGS

The features and advantages of the present invention will be more clearly understood from the following detailed description taken in conjunction with the accompanying FIGURES where like numerals refer to like and corresponding parts and in which.

DESCRIPTION OF A PREFERRED EMBODIMENT

Generally the present invention provides a voltage regulator with an automatic accelerated aging circuit. The voltage regulator includes a comparator, a switched voltage divider, and a current-to-voltage converter. The voltage regulator is implemented in an integrated circuit and monitors a power supply voltage provided to the integrated circuit. When the power supply voltage is within a first normal voltage range, the voltage regulator provides a normal internal supply voltage to the integrated circuit. When the power supply voltage is within a second higher voltage range, the voltage regulator automatically provides a higher than normal internal power supply voltage to the circuits of an integrated circuit for causing accelerated aging of the integrated circuit during burn-in reliability testing.

Figure 1:
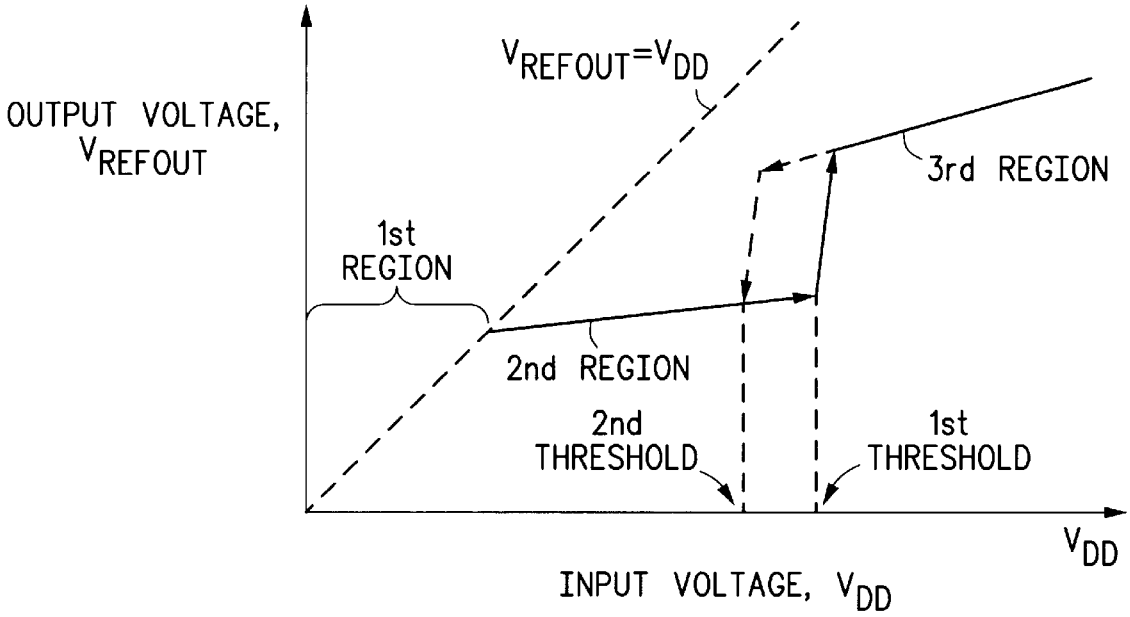
FIG. 1 illustrates, in graphical form, the relationship between an input supply voltage, $V_{DD}$, and the output voltage $V_{REFOUT}$, according to the disclosed invention.

FIG. 1 illustrates, in graphical form, the relationship between an input supply voltage, $V_{DD}$, and the output voltage, $V_{REFOUT}$, according to the disclosed invention. An integrated circuit voltage regulator with automatic accelerated aging circuit, described below, generates the output voltage $V_{REFOUT}$ as a function of the input voltage $V_{DD}$. For purposes of illustration, the characteristics of the output voltage may be conveniently segmented into three portions, labeled 1st Region, 2nd Region, and 3rd Region. In this first region, the input voltage is below that specified for proper operation of the voltage regulator. In the second region, the input voltage is within a predetermined range to cause the output voltage to be generally constant and set by the physical characteristics of the circuits described below. In this second region, the voltage regulator may be advantageously used to provide a relatively constant voltage level to a circuit connected to the voltage regulator. Note that the graph of FIG. 1 is provided for the purpose of explaining the present invention and is not drawn to scale.

In the third region, as $V_{DD}$ increases, the output voltage $V_{REFOUT}$ increases abruptly at a first threshold from the relatively constant level and then slowly increases as the input voltage increases. Here, the input voltage is predetermined to be greater than that specified for proper operation of the voltage regulator. However, this region is useful to provide a voltage level used by the manufacturer in, for example, burn-in testing to accelerate aging of an integrated circuit to speed up the testing process. To accelerate the appearance of the effects of aging on an integrated circuit, a higher than normal voltage level is applied to the integrated circuit in order to apply more voltage stresses to the circuit than would occur in the same time period with normal supply voltages. The manufacturer can thereby quickly discover design or manufacturing problems. However, if the higher than normal voltage is too high, unintentional permanent damage can be caused to the integrated circuit.

The disclosed voltage regulator does not allow the output voltage $V_{REFOUT}$ to rise to the same level as the input supply voltage $V_{DD}$. This limitation prevents permanent circuit breakdown caused by an over voltage condition. The dashed line indicates that the voltage regulator includes hysteresis when the input voltage $V_{DD}$ is decreasing from the third region to the second region. The use of hysteresis ensures that the output voltage $V_{REFOUT}$ does not return to the second region unless the input voltage drops to a second threshold, below the first threshold.

Figure 2:
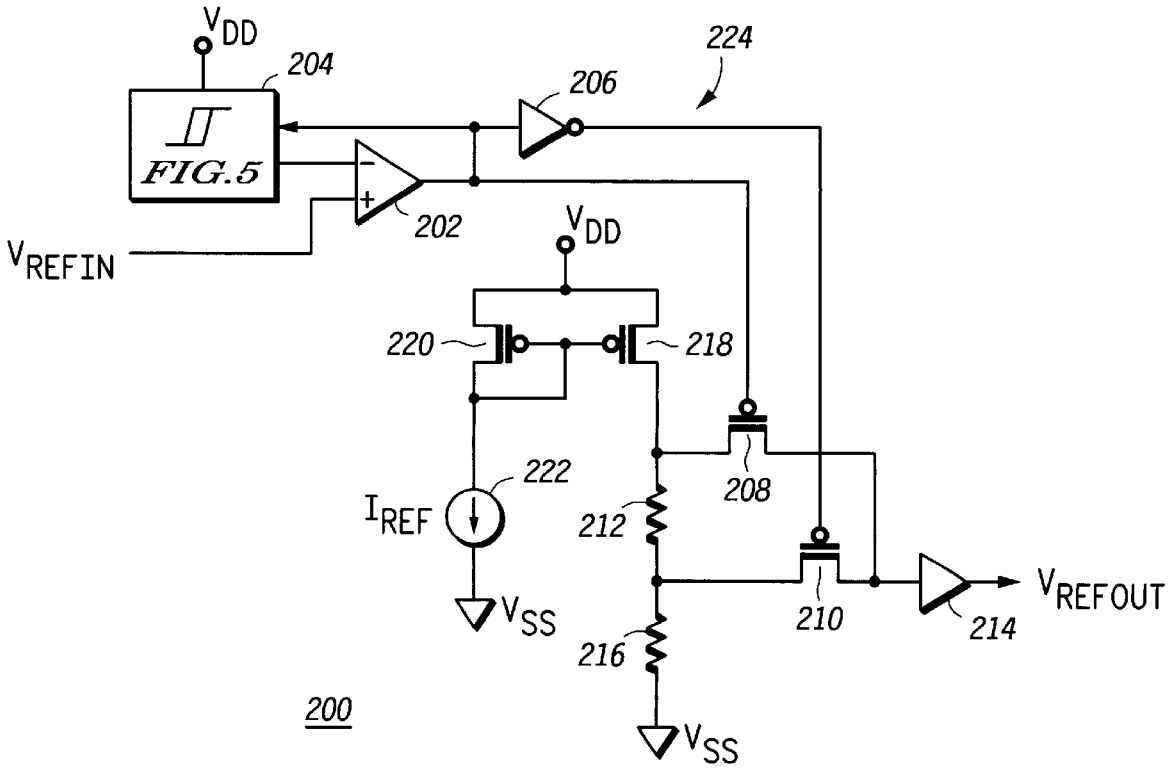
FIG. 2 illustrates, in partial schematic form and partial block form, a first embodiment of a voltage regulator with an automatic accelerated aging circuit.

FIG. 2 illustrates, in partial schematic form and partial block form, a first embodiment of a voltage regulator with automatic accelerated aging circuit 200. A comparator 202 receives an output of a voltage divider with hysteresis 204 and an intermediate, or reference voltage, $V_{REFIN}$, at its negative and positive terminals, respectively. Intermediate voltage, $V_{REFIN}$, may be generated using, for example, a circuit such as the circuit illustrated in FIG. 3 for generating $V_{REFIN}$, which will be discussed later. Voltage divider 204 receives as inputs, an input voltage, $V_{DD}$, and an output of comparator 202. The output of comparator 202 is also connected to an input of an inverter 206 and to a control electrode of a transistor 208. An output of inverter 206 is connected to a control electrode of a transistor 210. A first current electrode of transistor 210 and a first current electrode of transistor 208 are connected to a first and to a second terminal of a resistor 212, respectively. A second current electrode of transistor 210 and a second current electrode of transistor 208 are connected together and to an input of a buffer 214. An output of buffer 214 provides the output voltage, $V_{REFOUT}$. The first terminal of resistor 212 is also connected to a first terminal of a resistor 216. A second terminal of resistor 216 is connected to an input voltage, $V_{SS}$. In the illustrated embodiment, $V_{SS}$ is coupled to ground. The second terminal of resistor 212 and the first current electrode of transistor 208 are connected to a first current electrode of a transistor 218. A second current electrode and a control electrode of transistor 218 are connected to the input voltage, $V_{DD}$, and to a control electrode of a transistor 220, respectively. A first current electrode of transistor 220 is connected to the input voltage, $V_{DD}$. A second current electrode of transistor 220 is connected to its control electrode and to a first terminal of a current generator 222. A second terminal of current generator 222 is connected to the input voltage, $V_{SS}$. Elements 206, 208, 210, 212, 216, 218, and 220 form a current-to-voltage converter 224. In the embodiment depicted in FIG. 2, transistors 208, 210, 218, and 220 are p-channel metal oxide semiconductor field effect transistors (MOSFETs). In other embodiments, it may be appropriate to replace these transistors with n-channel MOSFETs or with transistors fabricated in other semiconductor processes. Also, the intermediate input voltage, $V_{REFIN}$, may be generated by connecting the positive terminal of comparator 202 to the first current electrode of transistor 210.

The operation of voltage regulator 200 may be conveniently described with respect to its two modes of operation: normal mode and accelerated aging mode. These two modes correspond to the second and third regions of the graph depicted in FIG. 1, above.

In the normal mode of operation, voltage regulator 200 receives an input voltage, $V_{DD}$, which is in its normal operating range. Voltage regulator 200 receives the intermediate reference voltage, $V_{REFIN}$, and reference current $I_{REF}$. As described below in connection with FIG. 6, these two parameters are generally constant for the normal range of input voltage levels. The reference current is mirrored by transistors 220 and 218 to develop a voltage drop across resistors 212 and 216. The output of voltage divider 204 is designed to be lower than the intermediate voltage level in the normal mode. Consequently, the positive output of comparator 202 places transistor 210 into a conducting state and transistor 208 into a non-conducting state. The voltage developed across resistor 216 is applied to and output by buffer 214 as $V_{REFOUT}$. This output voltage is generally constant.

In the accelerated aging mode of operation, voltage regulator 200 receives an input power supply voltage, $V_{DD}$, which is above its normal operating range. Again, voltage regulator 200 receives the intermediate voltage, $V_{REFIN}$, and reference current $I_{REF}$. Transistors 220 and 218 form a current mirror. The current through transistor 220 is mirrored by transistor 218 to develop a voltage drop across resistors 212 and 216. Initially, the input voltage rises above a first threshold, causing the output of voltage divider 204 to be higher than the intermediate voltage level. Consequently, the negative output of comparator 202 places transistor 208 into a conducting state and transistor 210 into a non-conducting state. In this mode, the voltage developed across resistors 212 and 216 is applied to and output by buffer 214 as $V_{REFOUT}$. This accelerated aging output voltage is higher than in the normal operating mode and is determined by the resistance of the resistors 212 and 216. In the illustrated embodiment, voltage regulator 200 does not allow the output voltage to rise fully to the input power supply voltage, $V_{DD}$. Also, buffer 214 is a unity voltage gain buffer.

Also, the negative output of comparator 202 causes voltage divider 204 to attenuate its output less. This decreased attenuation lowers the voltage at which comparator 202 will change its output. Therefore, the input voltage must drop to a second threshold, lower than the first threshold, to return to the normal operating mode. This hysteresis effect prevents voltage regulator 200 from inadvertently exiting the accelerated aging mode. The input voltage, $V_{DD}$, will eventually drop below the second threshold once the accelerated aging test is over. The input voltage, once equal to or below the second threshold voltage, will cause comparator 202 to generate a positive output, turning the hysteresis off and returning the output voltage to the second region. Voltage divider 204 is described below in connection with FIG. 5.

Figure 3:
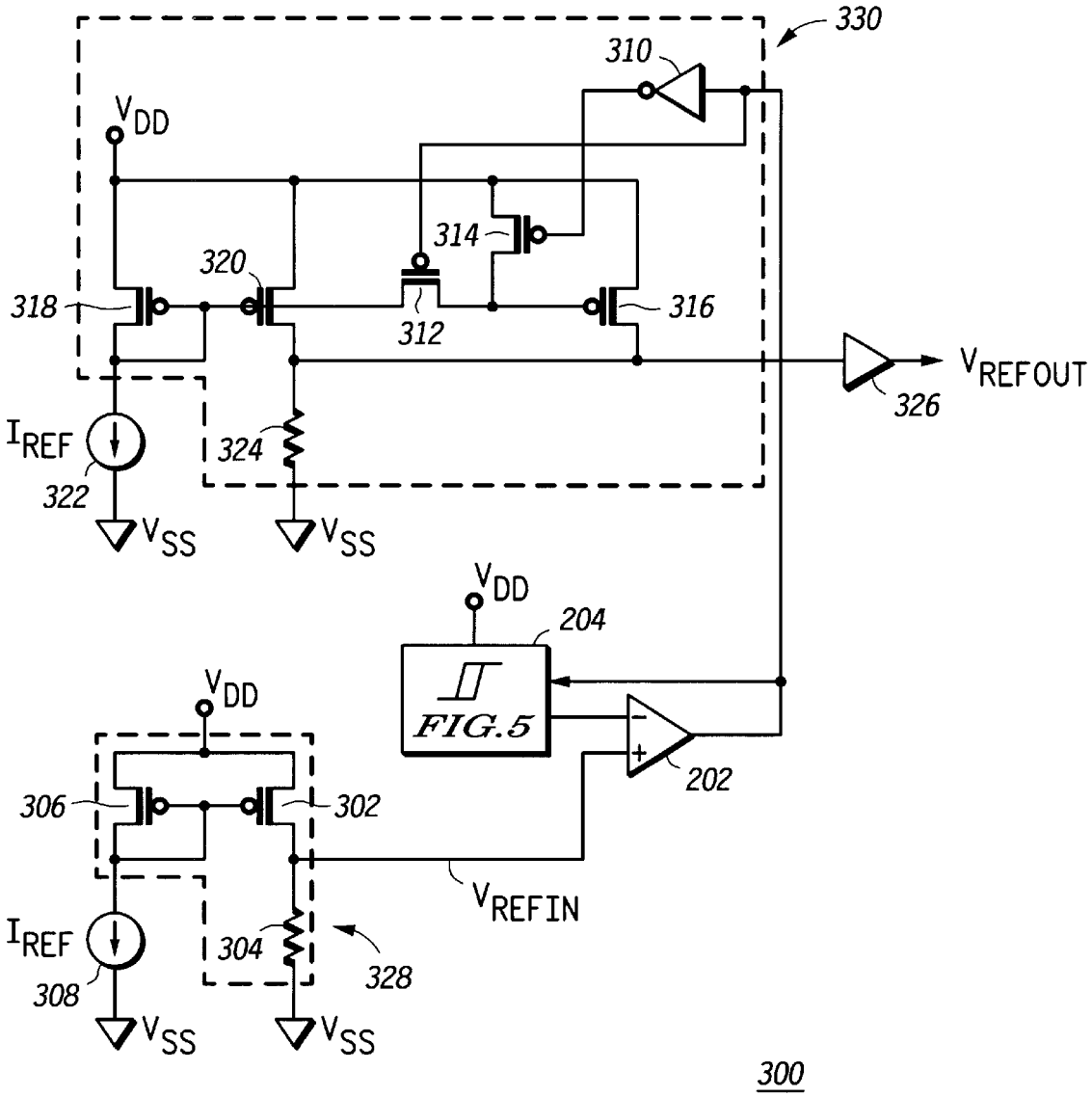
FIG. 3 illustrates, in partial schematic form and partial block form, a second embodiment of a voltage regulator with an automatic accelerated aging circuit.

FIG. 3 illustrates, in partial schematic form and partial block form, a second embodiment of a voltage regulator with automatic accelerated aging circuit 300. Elements 302, 304, and 306 form a current-to-voltage converter 328. Elements 310, 312, 314, 316, 318, 320, and 324 form a switchable current-to-voltage converter 330. Comparator 202 receives an output of voltage divider with switchable attenuation 204 and an intermediate reference voltage, $V_{REFIN}$, at its negative and positive terminals, respectively. A first current electrode of a transistor 302 and a first terminal of a resistor 304, coupled together, generate $V_{REFIN}$. A second current electrode of transistor 302 is connected to the input power supply voltage, $V_{DD}$. A control electrode of transistor 302 is coupled to a control electrode of a transistor 306. A second terminal of resistor 304 is connected to the input power supply voltage, $V_{SS}$. A first current electrode of transistor 306 is connected to a power supply voltage terminal to receive the input power supply voltage, $V_{DD}$. A second current electrode of transistor 306 is connected to its control electrode and to a first terminal of a current source 308. A second terminal of constant current source 308 is connected to a power supply voltage terminal to receive input power supply voltage, $V_{SS}$. In the illustrated embodiments, $V_{SS}$ is at ground potential. Voltage divider 204 receives as inputs, the input power supply voltage, $V_{DD}$, and an output of comparator 202.

The output of comparator 202 is also connected to an input of an inverter 310 and to a control electrode of a transistor 312. An output of inverter 310 is connected to a control electrode of a transistor 314. A first current electrode of transistor 314 is connected to the input power supply voltage, $V_{DD}$. A second current electrode of transistor 314 is connected to a first current electrode of transistor 312 and to a control electrode of a transistor 316. A first current electrode of transistor 316, a transistor 318, and a transistor 320 is each connected to the input power supply voltage, $V_{DD}$. A control electrode of each of transistors 318 and 320 is connected to a second current electrode of transistor 312. The control electrode of transistor 318 is also connected to its second current electrode and to a first terminal of a current source 322. A second terminal of current source 322 is connected to the input voltage, $V_{SS}$. A second current electrode of transistor 320 is connected to a second current electrode of transistor 316, to a first terminal of a resistor 324, and to an input of a buffer 326. A second terminal of resistor 324 is connected to the input voltage, $V_{SS}$. In the FIG. 3, $V_{SS}$ is coupled to ground. An output of buffer 326 generates the output voltage, $V_{REFOUT}$. In the illustrated embodiment, buffer 326 is a unity gain buffer.

In the embodiment depicted in FIG. 3, transistors 302, 306, 312, 314, 316, 318, and 320 are p-channel MOSFETs. In other embodiments, it may be appropriate to replace these transistors with n-channel MOSFETs or with transistors fabricated in other semiconductor processes.

The operation of voltage regulator 300 may also be conveniently described with respect to its two modes of operation: normal mode and accelerated aging mode. These two modes correspond to the second and third regions of the graph depicted in FIG. 1, above.

In the normal mode of operation, voltage regulator 300 receives input power supply voltage, $V_{DD}$, which is in its normal operating range. Voltage regulator 300 receives a reference current, $I_{REF}$. Current-to-voltage converter 328 generates the intermediate reference voltage, $V_{REFIN}$, and inputs it to the positive terminal of comparator 202. As described below in connection with FIG. 6, the reference current, $I_{REF}$, is generally constant for the normal range of input power supply voltage levels. The output of voltage divider 204 is designed to be lower than the intermediate voltage level in the normal mode. Consequently, the positive output of comparator 202 places transistor 312 into a non-conducting state and transistor 314 into a conducting state. Transistor 314 forces transistor 316 into the non-conducting state. Transistors 320 and 318 form a current mirror. The current through transistor 318 is mirrored by transistor 320 to develop a voltage drop across resistor 324. The voltage drop across resistor 324 is proportional to the current sourced by transistor 320 alone. The voltage developed across resistor 324 is applied to and output by buffer 326 as $V_{REFOUT}$. This output voltage is generally constant.

In the accelerated aging mode of operation, voltage regulator 300 receives an input power supply voltage, $V_{DD}$, which is above its normal operating range. Again, voltage regulator 300 receives the reference current $I_{REF}$ and generates the intermediate reference voltage, $V_{REFIN}$. Initially, the input voltage rises above a first threshold (as illustrated in FIG. 1), causing the output of voltage divider 204 to be higher than the intermediate reference voltage level. Consequently, the high voltage at the negative input of comparator 202 causes comparator 202 to output a low voltage that places transistor 312 into a conducting state and transistor 314 into a non-conducting state. In this mode, the voltage developed across resistor 324 is proportional to the sum of the current sourced by transistor 320 and by transistor 316. This voltage is applied to and output by buffer 326 as $V_{REFOUT}$. This accelerated aging output voltage is higher than in the normal operating mode. However, the voltage regulator does not allow the output voltage to rise fully to the input power supply voltage, $V_{DD}$.

Also, the low output voltage of comparator 202 causes voltage divider 204 to attenuate its output less. This decreased attenuation lowers the voltage at which comparator 202 will change its output. Therefore, the input voltage must drop to the second threshold (as illustrated in FIG. 1), which is lower than the first threshold, to return to the normal operating mode. This hysteresis effect prevents voltage regulator 300 from inadvertently exiting the accelerated aging mode if $V_{DD}$ fluctuates near the first threshold. The input power supply voltage, $V_{DD}$, is returned to below the second threshold once the accelerated aging is over. The input voltage, once below the second threshold voltage, will cause comparator 202 to generate a high output, turning the hysteresis off and returning the output voltage to the second region. Voltage divider 204 is described below in connection with FIG. 5.

Figure 4:
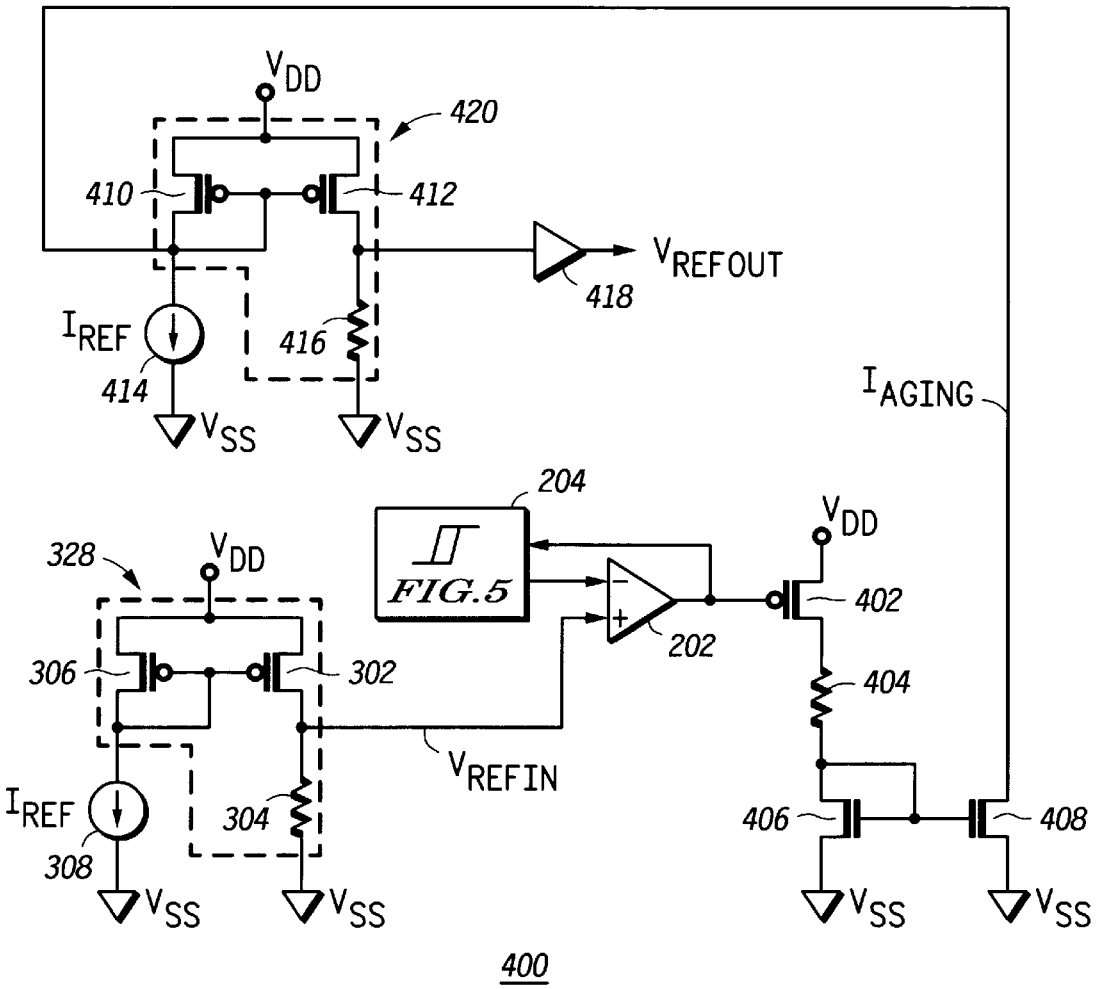
FIG. 4 illustrates, in partial schematic form and partial block form, a third embodiment of a voltage regulator with automatic accelerated aging circuit.

FIG. 4 illustrates, in partial schematic form and partial block form, a third embodiment of a voltage regulator with automatic accelerated aging circuit 400. Elements 302, 304, and 306 form a current-to-voltage converter 328. Elements 410, 412, and 416 form a current-to-voltage converter 420. Comparator 202 receives an output of voltage divider with switchable attenuation 204 and an intermediate reference voltage, $V_{REFIN}$, at its negative and positive input terminals, respectively. A first current electrode of a transistor 302 and a first terminal of a resistor 304, coupled together, generate $V_{REFIN}$. A second current electrode and a control electrode of transistor 302 are connected to receive the input power supply voltage, $V_{DD}$, and to a control electrode of a transistor 306, respectively. A second terminal of resistor 304 is connected to receive the input power supply voltage, $V_{SS}$. A first current electrode of transistor 306 is connected to the input voltage, $V_{DD}$. A second current electrode of transistor 306 is connected to its control electrode and to a first terminal of a current source 308. A second terminal of current source 308 is connected to receive the input power supply voltage, $V_{SS}$. Voltage divider 204 receives as inputs, an input voltage, $V_{DD}$, and an output of comparator 202.

The output terminal of comparator 202 provides a control signal and is also connected to a control electrode of a transistor 402. A first current electrode and a second current electrode of transistor 402 are connected to the input voltage, $V_{DD}$ and to a first terminal of a resistor 404, respectively. A second terminal of resistor 404 is connected to a first current electrode and to a control electrode of a transistor 406 and to a control electrode of transistor 408. Transistors 406 and 408 form a current mirror. A second current electrode of transistor 406 is connected to receive the input power supply voltage, $V_{SS}$. A first current electrode of transistor 408 is connected to receive the input power supply voltage, $V_{SS}$. A second current electrode of transistor 408 is connected to a first current electrode of a transistor 410, to a control electrode of transistor 410, to a first terminal of a constant current source 414, and to a control electrode of a transistor 412. A second current electrode of both of transistors 410 and 412 are connected to receive the input power supply voltage, $V_{DD}$. A second terminal of constant current source 414 is connected to the input power supply voltage, $V_{SS}$. A first current electrode of transistor 412 is connected to a first terminal of a resistor 416 and to an input of buffer 418. A second terminal of resistor 416 is connected to receive the input power supply voltage, $V_{SS}$. An output of buffer 418 provides the output voltage, $V_{REFOUT}$. In the illustrated embodiment, buffer 418 is a unity voltage gain buffer.

In the embodiment depicted in FIG. 4, transistors 302, 306, 402, 410, and 412 are p-channel MOSFETs. Conversely, transistors 406 and 408 are n-channel MOSFETs. In other embodiments, it may be appropriate to replace these transistors with transistors of opposite conductivity type or with transistors fabricated using other semiconductor manufacturing processes.

The operation of voltage regulator 400 may also be conveniently described with respect to its two modes of operation: normal mode and accelerated aging mode. These two modes correspond to the second and third regions of the graph depicted in FIG. 1, above.

In the normal mode of operation, voltage regulator 400 receives an input power supply voltage, $V_{DD}$, which is in its normal operating range. Voltage regulator 400 receives a reference current, $I_{REF}$. Current-to-voltage converter 328 generates the intermediate reference voltage, $V_{REFIN}$, and inputs it to the positive terminal of comparator 202. As described below in connection with FIG. 6, the reference current, $I_{REF}$, is generally constant for the normal range of input voltage levels. The output of voltage divider 204 is designed to be lower than the intermediate reference voltage level in the normal mode, and comparator 202 provides a high output voltage. Consequently, the high output of comparator 202 places transistor 402 into a non-conducting state. With transistor 402 in a non-conducting state, there is no current in resistor 404 and transistor 406. Transistors 406 and 408 form a current mirror. With no current in transistor 406, mirror transistor 408 also has no current. Transistors 410 and 412 also form a current mirror. The current through transistor 410 is mirrored by transistor 412 to develop a voltage drop across resistor 416. Since there is no current in transistor 408, the only current in transistor 410 is the current from current source $I_{REF}$. The voltage drop across resistor 416 is proportional to the current sourced by transistor 410. The voltage developed across resistor 416 is applied to and output by buffer 418 as $V_{REFOUT}$. This output voltage is generally constant for a normal operating voltage.

In the accelerated aging mode of operation, voltage regulator 400 receives an input power supply voltage, $V_{DD}$, which is above its normal operating range. Again, voltage regulator 400 receives the reference current $I_{REF}$ and generates the intermediate reference voltage, $V_{REFIN}$. Initially, the input voltage rises above a first threshold, causing the output of voltage divider 204 to be higher than the intermediate voltage level, thus causing comparator 202 to provide a low voltage. Consequently, the low output voltage of comparator 202 places transistor 402 into a conducting state. In this mode, a current through transistor 406 is mirrored by transistor 408. This current, $I_{AGING}$, is applied to the first current electrode of transistor 410. A current through transistor 410 is the sum of the reference current $I_{REF}$ and the current $I_{AGING}$. The current through transistor 410 is mirror by transistor 412. Therefore, a voltage drop across resistor 416 is proportional to the current sourced by transistor 410. The voltage developed across resistor 416 is applied to and output by buffer 418 as $V_{REFOUT}$. This accelerated aging output voltage is higher than in the normal operating mode and slowly increases with input voltage. However, the voltage regulator does not allow the output voltage to rise fully to the input power supply voltage, $V_{DD}$.

Also, the low output of comparator 202 causes voltage divider 204 to attenuate its output less. This decreased attenuation lowers the voltage at which comparator 202 will change its output. Therefore, the input voltage must drop to a second threshold, lower than the first threshold, to return to the normal operating mode. This hysteresis effect prevents voltage regulator 400 from inadvertently exiting the accelerated aging mode. The input power supply voltage, $V_{DD}$, is reduced to below the second threshold once the accelerated aging is completed to return the voltage regulator to the normal operating mode. The input voltage, once below the second threshold voltage, will cause comparator 202 to generate a high output, returning the output voltage to the second region, causing voltage divider 204 to return to its higher attenuation, and returning the threshold to the first value. Voltage divider 204 is described below in connection with FIG. 5.

Figure 5:
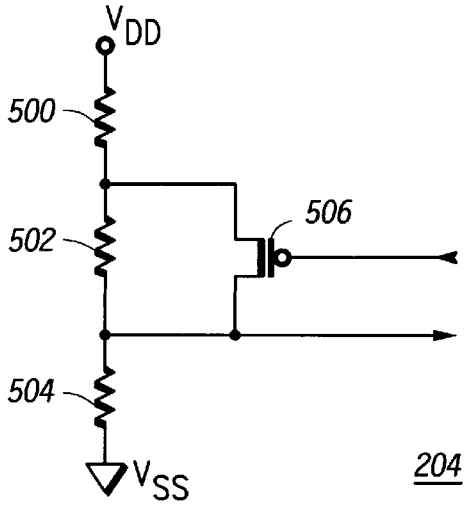
FIG. 5 illustrates, in schematic form, the voltage divider with hysteresis depicted in FIGS. 2 through 4.

FIG. 5 illustrates, in schematic form, the voltage divider with switchable attenuation 204 depicted in FIGS. 2 through 4. Three resistors, 500, 502, and 504 are connected in series between the input power supply voltage, $V_{DD}$, and the input power supply voltage, $V_{SS}$. Note that $V_{SS}$ is coupled to ground in the illustrated embodiment. A first current electrode of a transistor 506 is connected to the common node between resistors 500 and 502. A second current electrode of transistor 506 is connected to the common node between resistors 502 and 504. A control electrode of transistor 506 receives the input to voltage divider 204. The common node between resistors 502 and 504 generates the output of voltage divider 204.

As described above in connection with FIGS. 2 through 4, voltage divider 204 adjusts the voltage applied to the negative terminal of comparator 202 to prevent the various voltage regulators from inadvertently exiting the accelerated aging mode. In general, the voltage output by voltage divider 204 varies as a function of input voltage and mode. The voltage applied to the positive terminal of comparator 202, however, remains relatively constant. Note that in the above illustrated embodiments, comparator 202 is implemented as a CMOS operational amplifier where one of the two inputs is a reference voltage.

In the normal mode of operation, the input to voltage divider 204 is high, placing transistor 506 into a non-conducting state. The voltage output by voltage divider 204 varies linearly with the input voltages, $V_{DD}$ and $V_{SS}$. The particular coefficient is defined by the relationship:

$$V_{normal} = (V_{DD} - V_{SS}) * \frac{R_{504}}{R_{500} + R_{502} + R_{504}} + V_{SS}$$

In the accelerated aging mode of operation, the input to voltage divider 204 is low, placing transistor 506 into a conducting state. Assuming that the voltage drop across transistor 506 is negligible in the conducting state, the voltage output by voltage divider 204 varies linearly with the input power supply voltages, $V_{DD}$ and $V_{SS}$. In this case, the coefficient is defined by the relationship:

$$V_{accel.aging} = (V_{DD} - V_{SS}) * \frac{R_{504}}{R_{500} + R_{504}} + V_{SS}$$

The attenuation of the input voltage $V_{DD}$ is less in the accelerated aging mode than in the normal mode. Consequently, the voltage output by voltage divider 204 is larger in the accelerated aging mode than in the normal mode for a given input voltage $V_{DD}$. This larger voltage will prevent the voltage regulator from exiting the accelerated aging mode until the input voltage $V_{DD}$ drops to a level below that which triggered the accelerated aging mode. One skilled in the art, in conjunction with the present description, can select the various values of the three resistors to specify the first and second thresholds. Also, one skilled in the art will recognize that voltage divider 204 may be replaced with a voltage shifter or other circuit designed to provide an output voltage which is a function Of $V_{DD}$.

Figure 6:
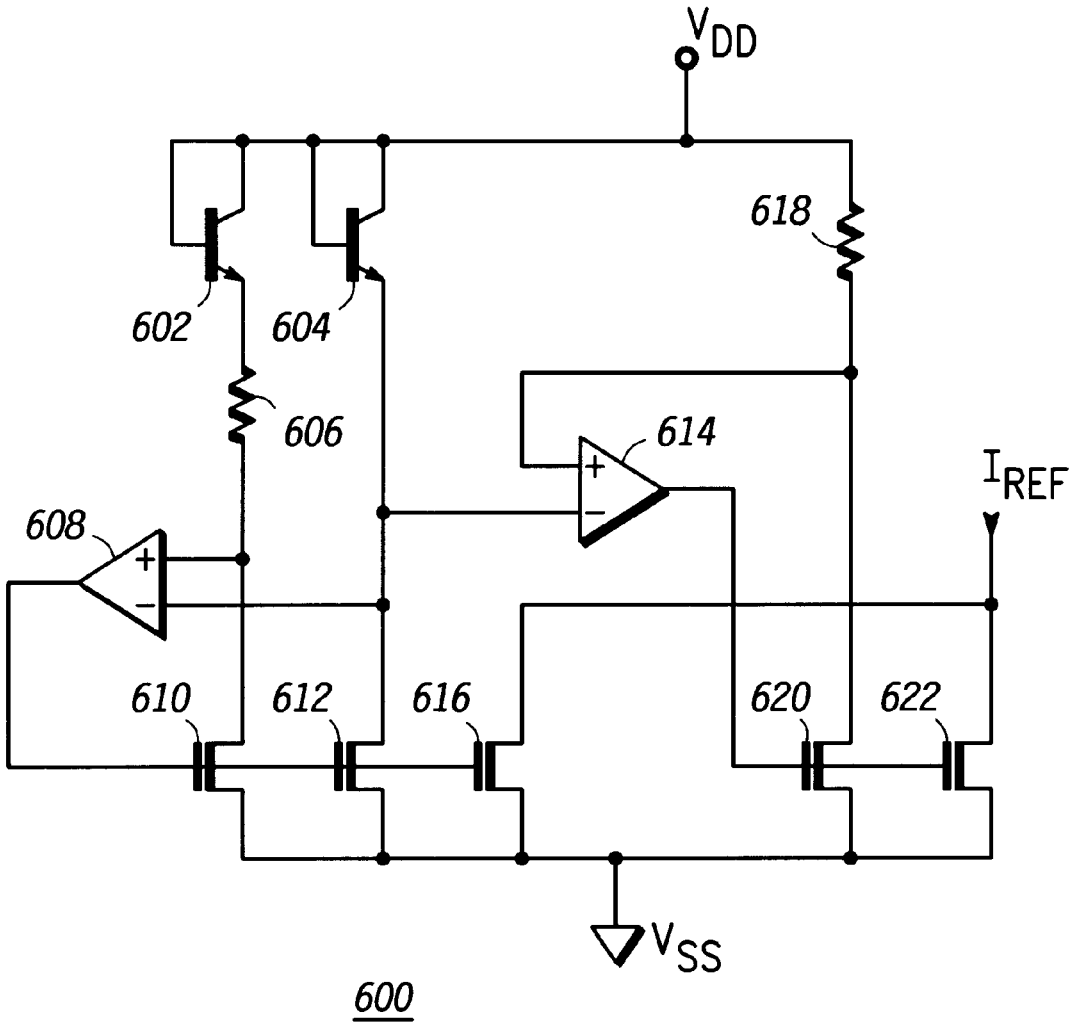
FIG. 6 illustrates, in partial schematic form and partial block form, a reference current generator for use with the voltage regulators depicted in FIGS. 2 through 4.

FIG. 6 illustrates, in partial schematic form and partial block form, a reference current generator 600 for use with the voltage regulators depicted in FIGS. 2 through 4. A first current electrode and a control electrode of a first transistor 602 are connected to receive the input power supply voltage $V_{DD}$. Similarly, a first current electrode and a control electrode of a second transistor 604 are connected to receive the input voltage supply $V_{DD}$. A second current electrode of transistor 602 is connected to a first terminal of a resistor 606. A second terminal of resistor 606 is connected to the positive input of a differential amplifier 608 and to a first current electrode of a transistor 610. A second current electrode of transistor 604 is connected to the negative input of differential amplifier 608, to a first current electrode of a transistor 612, and to a negative input of a differential amplifier 614. An output of differential amplifier 608 is connected to a control electrode of each of transistors 610, 612, and 616. A second current electrode of each of transistors 610, 612, and 616 is connected to the input power supply voltage, $V_{SS}$. A first terminal of a resistor 618 is connected to input voltage $V_{DD}$. A second terminal of resistor 618 is connected to a positive input of differential amplifier 614 and to a first current electrode of a transistor 620. An output of differential amplifier 614 is connected to a control electrode of transistors 620 and 622. A second current electrode of each of transistor 620 and 622 are connected to receive the input power supply voltage $V_{SS}$. A first current electrode of each of transistors 616 and 622 are connected together and generate the current $I_{REF}$.

In the embodiment depicted in FIG. 6, transistors 610, 612, 616, 620, and 622 are n-channel MOSFETs. In other embodiments, it may be appropriate to replace these transistors with p-channel MOSFETs or with transistors fabricated in other semiconductor processes. Transistors 602 and 604 are bipolar transistors. In other embodiments, they may be implemented as diodes or with transistors fabricated in other processes.

In operation, reference current generator produces a current, $I_{REF}$ which is the sum of (1) the current flowing through transistor 616 and (2) the current flowing through transistor 622. The current flowing through transistor 616 has a positive temperature-versus-current coefficient. Conversely, the current flowing through transistor 622 has a negative temperature-versus-current coefficient. One skilled in the art can design the components of the circuit such that the temperature coefficient of the sum of these two currents is inversely proportional to the temperature coefficient of the resistors used to implement the circuit. Thus, the temperature coefficient Of $I_{REF}$ is designed to compensate for the temperature coefficient of the resistors used in the current-to-voltage converters.

Continuing with current (1) above, transistor 616 and transistor 610 have the same gate-to-source voltage. Consequently, transistor 616 mirrors the current sunk by transistor 610:

$$I_{610} = I_{616} * \frac{W_{610}}{W_{616}}$$

where I and w, correspond to the current and width of the referenced device. Similarly, $$I_{612} = I_{616} * \frac{W_{612}}{W_{616}}$$

and $$I_{612} = I_{610} * \frac{W_{612}}{W_{610}}$$

From first principles, $$V_{602} = K_{602} T^{3+\frac{\gamma}{2}} e^{-\frac{E_g}{kT}} \left( e^{\frac{qV_{602}}{kT}} - 1 \right)$$

where V is the junction voltage for the element, $E_g$ is the semiconductor bandgap energy, k is Boltzmann's constant, T is the absolute temperature, q is the charge of an electron, K and I are the size factor for and the current of the corresponding element, and γ is a constant. Under the operating conditions of the circuit, the "1" in the above equation can be neglected and thus $$V_{602} = \frac{E_g}{q} - \frac{kT}{q} \ln\left( \frac{K_{602} T^{3+\frac{\gamma}{2}}}{I_{602}} \right)$$

Similarly $$V_{604} = \frac{E_g}{q} - \frac{kT}{q} \ln\left( \frac{K_{604} T^{3+\frac{\gamma}{2}}}{I_{604}} \right)$$

The voltage across resistor 606 is $$V_{606} = R_{606} I_{610}$$

The current flowing through transistor 610 can be determined by first noting that differential amplifier 608 modulates its output to force the voltage at its two inputs (first current electrodes of transistors 610 and 612) to the same value. Consequently, $$V_{602} + V_{606} = V_{604}$$

Noting that $I_{602}$ is the same as $I_{610}$ and that $I_{604}$ is the same at $I_{612}$ $$\frac{E_g}{q} - \frac{kT}{q} \ln\left( \frac{K_{602} T^{3+\frac{\gamma}{2}}}{I_{610}} \right) + R_{606} I_{610} = \frac{E_g}{q} - \frac{kT}{q} \ln\left( \frac{K_{604} T^{3+\frac{\gamma}{2}}}{I_{612}} \right)$$

or $$R_{606} I_{610} = \frac{kT}{q} \left[ \ln\left( \frac{K_{602} T^{3+\frac{\gamma}{2}}}{I_{610}} \right) - \ln\left( \frac{K_{604} T^{3+\frac{\gamma}{2}}}{I_{612}} \right) \right]$$

or after merging the logarithms and substituting for $I_{612}$ $$R_{606} I_{610} = \frac{kT}{q} \ln\left( \frac{K_{602} W_{612}}{K_{604} W_{610}} \right)$$

After substituting for $I_{610}$ $$I_{616} = \frac{W_{616}}{W_{610}} = \frac{kT}{qR_{606}} \ln\left( \frac{K_{602} W_{612}}{K_{604} W_{610}} \right)$$

Continuing with current (2) above, transistor 622 and transistor 620 have the same gate-to-source voltage. Consequently, transistor 622 mirrors the current sunk by transistor 620:

$$I_{622} = I_{620}\frac{W_{622}}{W_{620}}$$

Again, differential amplifier 614 modulates its output to force the voltage at its two inputs to the same value. Consequently, the current flowing through transistor 620 can be determined:

$$I_{620} = \frac{V_{604}}{R_{618}}$$

or $$I_{620} = \frac{\frac{E_g}{q} - \frac{kT}{q}\ln\left(\frac{K_{604}T^{3+\frac{\gamma}{2}}}{I_{604}}\right)}{R_{618}}.$$

But $$I_{604} = I_{612} = \frac{W_{612}}{W_{610}}\frac{kT}{qR_{606}}\ln\left(\frac{K_{602}W_{612}}{K_{604}W_{610}}\right)$$

So $$I_{620} = \frac{\frac{E_g}{q} - \frac{kT}{q}\ln\left(\frac{K_{604}T^{3+\frac{\gamma}{2}}}{\frac{W_{612}}{W_{610}}\frac{kT}{qR_{606}}\ln\left(\frac{K_{602}W_{612}}{K_{604}W_{610}}\right)}\right)}{R_{618}}$$

and $$I_{622} = \frac{W_{622}}{W_{620}}\frac{E_g}{q} - \frac{\frac{kT}{q}\ln\left(\frac{K_{604}T^{3+\frac{\gamma}{2}}}{\frac{W_{612}}{W_{610}}\frac{kT}{qR_{606}}\ln\left(\frac{K_{602}W_{612}}{K_{604}W_{610}}\right)}\right)}{R_{618}}$$

or $$I_{622} = \frac{E_g}{qR_{618}}\frac{W_{622}}{W_{620}} - \frac{W_{622}}{W_{620}}\frac{kT}{qR_{618}}\ln\left(\frac{K_{604}T^{3+\frac{\gamma}{2}}}{\frac{W_{612}}{W_{610}}\frac{kT}{qR_{606}}\ln\left(\frac{K_{602}W_{612}}{K_{604}W_{610}}\right)}\right)$$

The reference current $I_{REF}$ is defined as the sum of $I_{616}$ and $I_{622}$ and thus by the relationship:

$$I_{REF} = \frac{E_g}{qR_{618}}\frac{W_{622}}{W_{620}} + \frac{W_{616}}{W_{610}}\frac{kT}{qR_{606}}\ln\left(\frac{K_{602}W_{612}}{K_{604}W_{610}}\right) - \frac{W_{622}}{W_{620}}\frac{kT}{qR_{618}}\ln\left(\frac{K_{604}T^{3+\frac{\gamma}{2}}}{\frac{W_{612}}{W_{610}}\frac{kT}{qR_{606}}\ln\left(\frac{K_{602}W_{612}}{K_{604}W_{610}}\right)}\right)$$

or $$I_{REF} = \frac{E_g}{qR_{618}}\frac{W_{622}}{W_{620}} + \frac{kT}{q}\left[\frac{W_{616}}{W_{610}}\frac{1}{R_{606}}\ln\left(\frac{K_{602}W_{612}}{K_{604}W_{610}}\right) - \right.$$

-continued $$\left.\frac{W_{622}}{W_{620}}\frac{1}{R_{618}}\ln\left(\frac{K_{604}T^{2+\frac{\gamma}{2}}}{\frac{W_{612}}{W_{610}}\frac{k}{qR_{606}}\ln\left(\frac{K_{602}W_{612}}{K_{604}W_{610}}\right)}\right)\right]$$

One skilled in the art, in conjunction with this description, can select the various parameters defining these two currents such that the two terms in the bracket after the kT/q term virtually cancel each other over the temperature range of interest except for a very small logarithmic temperature variation. If this is done then $$I_{REF} \cong \frac{E_g}{qR_{618}}\frac{W_{622}}{W_{620}}$$

Note that the temperature variation of the reference current would be that due to the resistor $R_{618}$.

The above discussion should make it apparent that there has been provided an improved voltage regulator circuit. Further, it should be apparent that there are numerous modifications which can be made to the disclosed circuit. For example, the circuit could be manufactured in MOS, Bipolar, BiCMOS, or other technologies. The conductivity type of the illustrated transistors may be reversed. While the embodiment disclosed may specify specific transistor ratios or sizes, it is recognized that other transistor ratios and sizes could be used to meet the objectives of the invention. If desired, the invention could also be used to obtain an output voltage that varies over temperature by a known amount.

While the invention has been described in the context of a preferred embodiment, it will be apparent to those skilled in the art that the present invention may be modified in numerous ways and may assume many embodiments other than that specifically set out and described above. Accordingly, it is intended by the appended claims to cover all modifications of the invention which fall within the true spirit and scope of the invention.

What is claimed is:

1. A voltage regulator, comprising:

a comparator having a first input terminal for receiving a first reference voltage, a second input terminal, and an output terminal for providing a control signal, wherein the first reference voltage is provided by a circuit which causes the first reference voltage to be relatively constant;

a voltage source controlled by a power supply voltage, and in response, providing a second reference voltage to the second input terminal of the comparator, wherein the voltage source causes the second reference voltage to vary as a function of the power supply voltage; and a current-to-voltage converter, comprising:

a current mirror circuit having a first input terminal for receiving a reference current, a second input terminal for receiving the power supply voltage, and an output terminal;

a first transistor having a first current electrode coupled to the output terminal of current mirror circuit, a control electrode coupled to the output terminal of the comparator, and a second current electrode for providing a first output voltage;

a first resistor having a first terminal coupled to the first current electrode of the first transistor, and a second terminal;

a second transistor having a first current electrode coupled to the second terminal of the first resistor, a control electrode coupled, via an inverter, to the output terminal of the comparator, and a second current electrode coupled to the second current electrode of the first transistor for providing a second output voltage; and a second resistor having a first terminal coupled to the first current electrode of the second transistor, and a second terminal coupled to a ground terminal, wherein the first output voltage is provided in response to the second reference voltage being lower than the first reference voltage and the second output voltage is provided in response to the second reference voltage being higher than the first reference voltage.

2. The voltage regulator of claim 1, further comprising a hysteresis feedback path coupled from the output terminal of the comparator to the voltage source, for providing hysteresis to the voltage regulator.

3. The voltage regulator of claim 2, wherein the voltage source is characterized as being a voltage divider, the voltage divider comprising:

a third resistor having a first terminal coupled to the power supply voltage, and a second terminal;

a fourth resistor having a first terminal coupled to the second terminal of the third resistor, and a second terminal;

a third transistor having a first current electrode coupled to the first terminal of the fourth resistor, a second current electrode coupled the second terminal of the fourth resistor, and a control electrode coupled to the output terminal of the comparator; and a fifth resistor having a first terminal coupled to the second terminal of the fourth resistor, and a second terminal coupled to the ground terminal.

4. The voltage regulator of claim 1, wherein a temperature variation of the reference current compensates for a temperature variation of both of the first and second resistors.

5. The voltage regulator of claim 1, wherein the reference current is provided by a reference current generator, the reference current generator comprising:

a first diode having a first current electrode coupled to the power supply voltage, and a second current electrode;

a second diode having a first current electrode coupled to the power supply voltage, and a second current electrode;

a third resistor having a first terminal coupled to the second current electrode of the first diode, and a second terminal;

a first amplifier having a first input terminal coupled to the second terminal of the third resistor, a second input terminal coupled the second current electrode of the second diode, and an output terminal;

a third transistor having a first current electrode coupled to the second terminal of the third resistor, a control electrode coupled to the output terminal of the first amplifier, and a second current electrode coupled to the ground terminal;

a fourth transistor having a first current electrode coupled to the second current electrode of the second diode, a control electrode coupled to the output terminal of the first amplifier, and a second current electrode coupled to the ground terminal;

a fifth transistor having a first current electrode, a control electrode coupled to the output terminal of the first amplifier, and a second current electrode coupled to the ground terminal;

a fourth resistor having a first terminal coupled to the power supply voltage, and a second terminal;

a second amplifier having a first input terminal coupled to the second terminal of the fourth resistor, a second input terminal coupled to the second current electrode of the second diode, and an output terminal;

a sixth transistor having a first current electrode coupled to the second terminal of the fourth resistor, a control electrode coupled to the output terminal of the second amplifier, and a second current electrode coupled to the ground terminal; and a seventh transistor having a first current electrode for providing the reference current, the first current electrode coupled to the first current electrode of the fifth transistor, a control electrode coupled to the output terminal of the second amplifier, and a second current electrode coupled to the ground terminal.

6. The voltage regulator of claim 1, further comprising a unity gain output buffer having an input terminal coupled to the second current electrodes of the first and second transistors, and an output terminal for providing buffered first and second output voltages.

7. A voltage regulator with an accelerated aging circuit, the accelerated aging circuit comprising:

a first current-to-voltage converter having an input terminal for receiving a relatively constant first reference current, and an output terminal for providing a relatively constant first reference voltage that is proportional to the first reference current;

a comparator having a first input terminal for receiving the first reference voltage, a second input terminal, and an output terminal for providing a control signal;

a voltage divider with hysteresis for receiving a power supply voltage, and in response, providing a second reference voltage to the second input terminal of the comparator, wherein the second reference voltage varies as the power supply voltage varies;

the first transistor having a first current electrode coupled to a power supply voltage, a control electrode coupled to the output terminal of the comparator, and a second current electrode;

a first resistor having a first terminal coupled to the second current electrode of the first transistor, and a second terminal;

a second transistor having a both a first current electrode and a control electrode coupled to the second terminal of the first resistor, and a second current electrode coupled to a ground terminal;

a third transistor having a first current electrode, a control electrode coupled to the second terminal of the first resistor, and a second current electrode coupled to the ground terminal;

a second current-to-voltage converter having a first input terminal for receiving a second reference current, a second input terminal coupled to said first current electrode of said third transistor, and an output terminal for providing a first output voltage in response to the second reference voltage being lower than the first reference voltage and for providing a second output voltage in response to the second reference voltage being higher than the first reference voltage.

8. The voltage regulator of claim 7, wherein the first reference current and the second reference current are relatively independent of temperature variations.

9. The voltage regulator of claim 7, further comprising a hysteresis feedback path coupled between the output terminal of the comparator and the voltage divider, for providing the hysteresis to the voltage divider.

10. The voltage regulator of claim 7, wherein the first reference current is provided by a reference current generator, the reference current generator comprising;

a first diode having a first current electrode coupled to the power supply voltage, and a second current electrode;

a second diode having a first current electrode coupled to the power supply voltage, and a second current electrode;

a first resistor having a first terminal coupled to the second current electrode of the first diode, and a second terminal;

a first amplifier having a first input terminal coupled to the second terminal of the first resistor, a second input terminal coupled the second current electrode of the second diode, and an output terminal;

a first transistor having a first current electrode coupled to the second terminal of the first resistor, a control electrode coupled to the output terminal of the first amplifier, and a second current electrode coupled to the ground terminal;

a second transistor having a first current electrode coupled to the second current electrode of the second diode, a control electrode coupled to the output terminal of the first amplifier, and a second current electrode coupled to the ground terminal;

a third transistor having a first current electrode, a control electrode coupled to the output terminal of the first amplifier, and a second current electrode coupled to the ground terminal;

a second resistor having a first terminal coupled to the power supply voltage, and a second terminal;

a second amplifier having a first input terminal coupled to the second terminal of the second resistor, a second input terminal coupled to the second current electrode of the second diode, and an output terminal;

a fourth transistor having a first current electrode coupled to the second terminal of the second resistor, a control electrode coupled to the output terminal of the second amplifier, and a second current electrode coupled to the ground terminal; and a fifth transistor having a first current electrode for providing the first reference current, the first current electrode coupled to the first current electrode of the third transistor, a control electrode coupled to the output terminal of the second amplifier, and a second current electrode coupled to the ground terminal.

11. A voltage regulator with an accelerated aging circuit, the accelerated aging circuit comprising:

a first current-to-voltage converter having an input terminal for receiving a relatively constant first reference current, and an output terminal for providing a relatively constant first reference voltage that is proportional to the first reference current;

a voltage divider with hysteresis for receiving a power supply voltage, and in response, providing a second reference voltage, wherein the second reference voltage varies as the power supply voltage varies;

a comparator having a first input terminal for receiving the first reference voltage, a second input terminal for receiving the second reference voltage, and an output terminal for providing a control signal at a first logic state when the first reference voltage is higher than the second reference voltage, and for providing the control signal at a second logic state when the first reference voltage is lower than the second reference voltage; and a second current-to-voltage converter having an input terminal for receiving a second reference current, and an output terminal for providing a first output voltage when the control signal is at the first logic state, and for providing a second output voltage, higher than the first output voltage when the control signal is at the second logic state.

12. The voltage regulator of claim 11, wherein the second current-to-voltage converter comprises:

a first transistor having a first current electrode coupled to the power supply voltage, a control electrode and a second current electrode, both for receiving the second reference current;

a second transistor having a first current electrode coupled to the power supply voltage, a control electrode coupled to the control electrode of the first transistor, and a second current electrode;

a resistor having a first terminal coupled to the second current electrode of the second transistor, and a second terminal coupled to the ground terminal;

a third transistor having a first current electrode coupled to receive the power supply voltage, a control electrode, and a second current electrode coupled to the second current electrode of the second transistor;

a fourth transistor having a first current electrode coupled to the control electrode of the second transistor, a control electrode coupled to the output terminal of the comparator, and a second current electrode coupled the control electrode of the third transistor;

a fifth transistor having a first current electrode coupled to the power supply voltage terminal, a control electrode, and a second current electrode coupled to the control electrode of the third transistor; and an inverter having an input terminal coupled to the output terminal of the comparator, and an output terminal coupled to the control electrode of the fifth transistor.

13. A voltage regulator with an accelerated aging circuit, the accelerated aging circuit comprising:

a first current-to-voltage converter having an input terminal for receiving a relatively constant first reference current, and an output terminal for providing a relatively constant first reference voltage that is proportional to the first reference current;

a voltage divider with hysteresis for receiving a power supply voltage, and in response, providing a second reference voltage, wherein the second reference voltage varies as the power supply voltage varies;

a comparator having a first input terminal for receiving the first reference voltage, a second input terminal for receiving the second reference voltage, and an output terminal for providing a control signal at a first logic state when the first reference voltage is higher than the second reference voltage, and for providing the control signal at a second logic state when the first reference voltage is lower than the second reference voltage;

a first transistor having a first current electrode coupled to the power supply voltage, a control electrode and a second current electrode coupled together to receive a second reference current;

a second transistor having a first current electrode coupled to the power supply voltage, a control electrode coupled to the control electrode of the first transistor, and a second current electrode;

a first resistor having a first terminal coupled to the first current electrode of the second transistor, and a second terminal;

a third transistor having a first current electrode coupled to the first terminal of the first resistor, a control electrode coupled to the output terminal of a comparator, and a second current electrode for providing the second output voltage;

a second resistor having a first terminal coupled to the second terminal of the first resistor, and a second terminal coupled to a ground terminal; and a fourth transistor having a first current electrode coupled to the second terminal of the first resistor, a control electrode coupled to the output terminal of the comparator, via an inverter, and a second current electrode for providing a first output voltage.

14. The voltage regulator of claim 13, wherein the first reference current and the second reference current are relatively independent of temperature variations.

15. The voltage regulator of claim 13, further comprising a hysteresis feedback path coupled between the output terminal of the comparator and the voltage divider, for providing the hysteresis for the voltage regulator.

16. The voltage regulator of claim 13, wherein the first reference current is provided by a reference current generator, the reference current generator comprising:

a first diode having a first current electrode coupled to the power supply voltage, and a second current electrode;

a second diode having a first current electrode coupled to the power supply voltage, and a second current electrode;

a first resistor having a first terminal coupled to the second current electrode of the first diode, and a second terminal;

a first amplifier having a first input terminal coupled to the second terminal of the first resistor, a second input terminal coupled the second current electrode of the second diode, and an output terminal;

a first transistor having a first current electrode coupled to the second terminal of the first resistor, a control electrode coupled to the output terminal of the first amplifier, and a second current electrode coupled to the ground terminal;

a second transistor having a first current electrode coupled to the second current electrode of the second diode, a control electrode coupled to the output terminal of the first amplifier, and a second current electrode coupled to the ground terminal;

a third transistor having a first current electrode, a control electrode coupled to the output terminal of the first amplifier, and a second current electrode coupled to the ground terminal;

a second resistor having a first terminal coupled to the power supply voltage, and a second terminal;

a second amplifier having a first input terminal coupled to the second terminal of the second resistor, a second input terminal coupled to the second current electrode of the second diode, and an output terminal;

a fourth transistor having a first current electrode coupled to the second terminal of the second resistor, a control electrode coupled to the output terminal of the second amplifier, and a second current electrode coupled to the ground terminal; and a fifth transistor having a first current electrode for providing the first reference current, the first current electrode coupled to the first current electrode of the third transistor, a control electrode coupled to the output terminal of the second amplifier, and a second current electrode coupled to the ground terminal.

* * * * *

UNITED STATES PATENT AND TRADEMARK OFFICE

CERTIFICATE OF CORRECTION

PATENT NO. : 6,091,287
DATED : July 18, 2000
INVENTOR(S) : Salter et al.

It is certified that error appears in the above-identified patent and that said Letters Patent is hereby corrected as shown below:

Column 1,
Line 3, after the Title, please add as a new first paragraph the following paragraph:
-- This invention was made with Government support under Agreement No. MDA972-96-3-0016 awarded by DARPA. The Government has certain rights in the invention. --

Signed and Sealed this

Nineteenth Day of August, 2003

JAMES E. ROGAN
*Director of the United States Patent and Trademark Office*